United States Patent [19]

Swanson

[11] 4,040,267

[45] Aug. 9, 1977

[54] ICE MAKER WITH THERMOSTATIC WATER CONTROL

[75] Inventor: Donald F. Swanson, St. Paul, Minn.

[73] Assignee: Whirlpool Corporation, Benton Harbor, Mich.

[21] Appl. No.: 698,471

[22] Filed: June 21, 1976

[51] Int. Cl.[2] ..... F25C 5/02

[52] U.S. Cl. ..... 62/180; 62/189; 62/354

[58] Field of Search ..... 62/354, 189, 180, 138

[56] References Cited

U.S. PATENT DOCUMENTS

| | | | |
|---|---|---|---|
| 3,643,454 | 2/1972 | Turner | 62/354 X |
| 3,744,266 | 7/1973 | Beusch | 62/189 |

*Primary Examiner*—William E. Wayner
*Assistant Examiner*—William E. Tapolcai, Jr.
*Attorney, Agent, or Firm*—Wegner, Stellman, McCord, Wiles & Wood

[57] ABSTRACT

An ice maker of the type where water in excess of the freezing capacity is directed over a cylindrical surface member that is refrigerated to a subfreezing temperature to form ice thereon and from which the ice is harvested in combination with a thermostatic water valve means having a control portion in heat exchange relationship with the low pressure side of the refrigerating means that provides the subfreezing temperature for regulating the volumetric water supply to the surface in inverse ratio to the temperature of the low pressure side of the refrigerating means so that when the temperature is higher than desired the water flow is restricted or stopped so as to prevent waste. Then, when the temperature of the low pressure side of the refrigerating means and thus the cylindrical surface is sufficiently low the volumetric flow of water is increased.

16 Claims, 4 Drawing Figures

ICE MAKER WITH THERMOSTATIC WATER CONTROL

BACKGROUND OF THE INVENTION

This invention relates to an ice maker and a method of making ice in which water is frozen on a refrigerated surface from which it is harvested and the rate of water flow to this surface is regulated by a thermostatic water valve means having a control portion in heat exchange relationship with the low pressure side of the refrigerating means so that the supply of water to the refrigerated surface is in inverse ratio to the temperature of the surface. Accordingly, water is supplied to the refrigerated surface in volumetrically varying amounts proportionate to the capacity of the refrigerating means to make ice.

Another feature of the invention is to provide a method of producing ice in which water is fed to an ice maker as a function of the ice making capability of the ice maker under varying temperature and apparatus operating conditions which comprises feeding water to a freezing surface that is maintained at a subfreezing temperature by means of a refrigerant evaporator having a refrigerant inlet line and a gaseous refrigerant suction line and varying the volumetric flow of water through the zone in inverse ratio to the temperature of the zone and preferably in inverse ration to the temperature of the refrigerant suction line.

U.S. Pat. No. 3,643,454 discloses an ice maker having a gravity flow water supply system to the refrigerated surface from a water reservoir above the refrigerated surface. The water supply to the reservoir may be regulated by the demand for the finished ice product. There is no temperature controlled water supply means.

U.S. Pat. No. 3,744,266 discloses an ice maker in which the supply of water is regulated by the pressure of a static column of water formed by a constant flow drain.

Neither of these prior patents nor any other patent or reference of which applicant is aware discloses a thermostatically controlled water supply operating in inverse ratio to the temperature of the freezing surface as is the case with the present invention.

SUMMARY OF THE INVENTION

Basically the apparatus and method of this invention control the water supply to the freezing surface in inverse ratio to the temperature of this surface which in turn is controlled by the temperature in the refrigerant evaporator used to chill this surface to a subfreezing temperature. Thus water is supplied in proportion to the capacity of the refrigerating means to make ice. These temperatures are affected by and therefore are a function of the ambient operating conditions to which the ice maker is exposed with the result that the water is fed to the ice maker as a function of the ice making capability of the ice maker under those ambient conditions. In addition, the thermostatic water valve used to control the water supply automatically compensates for unfavorable conditions such as a dirty condenser which might otherwise adversely affect the mechanical and refrigeration system by placing undesirable stresses on the components of the ice maker.

DESCRIPTION OF THE PREFERRED EMBODIMENT

Figure 1:
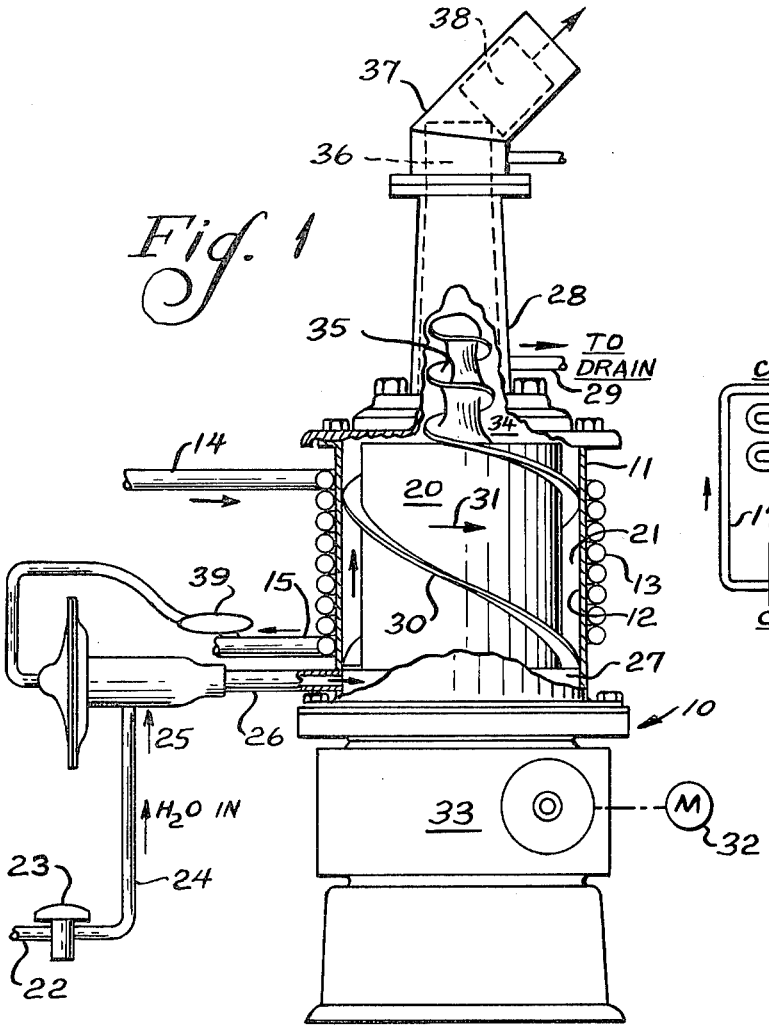
FIG. 1 is a side elevational view partially in section of a commercial ice maker embodying the invention.

The ice maker illustrated in the accompanying drawings is generally of the commercial type illustrated in U.S. Pat. No. 3,643,454 assigned to the assignee hereof. The illustrated ice maker 10 includes the cylinder 11 having an inner surface 12 which is adapted to be chilled to a subfreezing temperature by a refrigerant flowing through evaporator coil 13 in heat exchange relationship with the outer surface of the cylinder. Connected to evaporator 13 are a liquid refrigerant line 14 leading to the evaporator coil 13 and a gaseous refrigerant suction line 15 leading from the coil 13.

Figure 2:
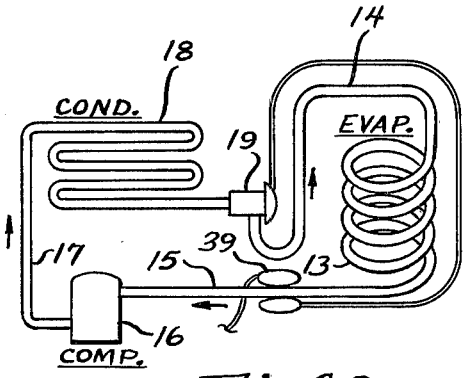
FIG. 2 is a flow diagram of the refrigeration system of the embodiment of FIG. 1.

As illustrated in FIG. 2 the evaporator 13 is a part of a refrigeration system in which the suction line 15 leads to a refrigerant compressor 16 which is connected by a line 17 to a condenser 18 in which the refrigerant is returned to its liquid condition and is then directed through an expansion valve 19 to the evaporator 13. Flow through the expansion valve 19 is controlled by temperature sensing bulb 19' attached to the suction line in heat exchange relationship. The evaporator 13 and suction line 15 form the low pressure side of the refrigerating means. Thus the refrigeration system of FIG. 2 is conventional.

The space between the inner surface 12 of the cylinder 11 on which the ice is formed and an ice harvest auger 20 provides an annular water flow passage 21.

As is customary in ice makers of this type the system provides for a flow of water through the passage 21 in excess of the freezing capacity of the apparatus so that ice will be built up on the inner cylinder surface 12. In the ice maker of this invention as illustrated in the drawings, water is directed from an ice maker water inlet 22 through a pressure regulator 23 designed to supply water at a pressure of 25 psi, for example, and from the regulator 23 the water flows through a line 24 to the thermostatic water valve 25.

From the water valve 25 a water line 26 leads to a manifold chamber 27 at the lower end of the annular passage 21 so as to be directed upwardly in this passage.

During the upward flow in the passage 21 ice builds up on the refrigerated inner surface 12 of the cylinder 11. The water supply in excess of the amount frozen is directed upwardly into a nozzle 28 and passes through a line 29 to a drain, all as explained in the above U.S. Pat. No. 3,643,454.

The outer surface of the auger 20 is provided with a helical blade 30 that substantially spans the space 21. This auger blade is angled so that when the auger 20 is rotated in the direction 31 by a motor 32 driving a gear reducer 33, the ice is scraped from the surface 12, raised to the top chamber 34 above the auger 20 and to the bottom of the nozzle 28 where it is engaged by a second and smaller auger 35 pitched in the same general direction as the first auger 20 and substantially coaxial with the first auger 20. Auger 35 compresses the harvested ice by forcing it upwardly in the tapered nozzle 28 which compresses the ice into a column, squeezes excess water from it which flows out through the drain 29 and forces the ice column 36 through a breaker elbow 37 to break the column 36 into successive ice blocks 38 of which only one is shown in dotted lines at the top of FIG. 1.

Experience has shown that when an ice maker of this type has a single fixed rate of water supply, this supply is optimum for only one set of operating conditions and when the ice maker is affected by ambient conditions including air temperature as well as by the apparatus operating conditions, there is no way for compensating for these variables which are almost constantly changing. Therefore with a single rate water supply the flow rate is either excessive or insufficient. An excessive flow rate not only wastes water but also decreases ice production due to melting.

An insufficient water supply, on the other hand, tends to cause freeze-up conditions within the maker and particularly in the passage 21 thereby putting unnecessary and severe stresses on both the mechanical and refrigeration system of the ice maker. This invention, by providing an automatically regulated water supply, permits the ice maker to compensate for unfavorable mechanical and refrigeration conditions as well as for changing ambient conditions.

In order to provide this automatic varying of the water supply there is provided a variable flow means comprising the thermostatic water valve 25 having a control portion in heat exchange relationship with the low pressure side of the refrigerating means for regulating the volumetric water supply to the freezing surface 12 in inverse ration to the temperature of this surface. It is possible for the thermostatic water valve to set so that the control portion can be arranged in heat exchange relationship with the high side of the refrigerating means, however, it is preferred to use low side temperatures inasmuch as the low side temperatures are more directly related to the ice making capacity of the system.

In the illustrated embodiment this variable flow means is provided by the thermostatic water valve 25 which has a sensing bulb 39 attached in heat conducting relationship with the suction line 15. The temperature responsive fluid in the bulb 39 and connecting line 40 operates through a chamber 41 on one side of a diaphragm 42 in a diaphragm chamber 43. As illustrated in FIG. 2, the temperature responsive bulb 39 is typically attached to suction line 15 at the same location as temperature responsive bulb 19' of expansion valve 19.

Figure 3:
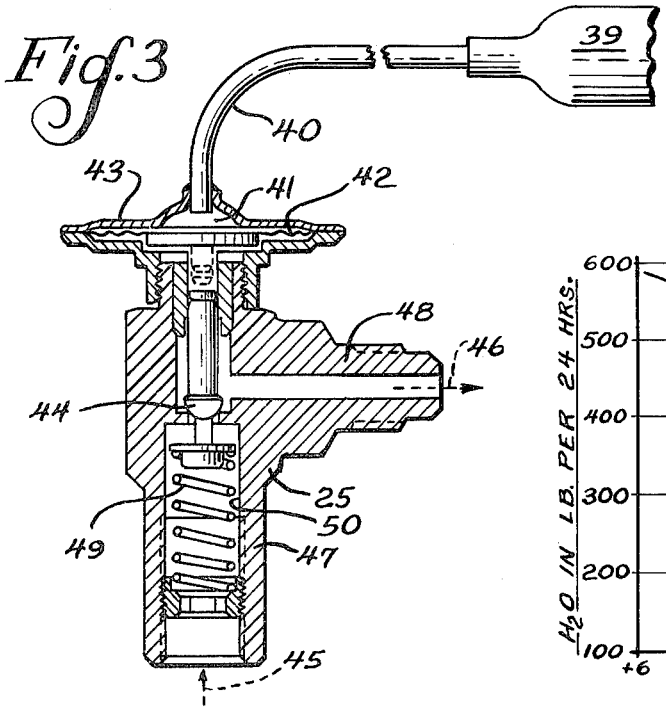
FIG. 3 is a sectional view through a thermostatic water valve used to control the water supply in the embodiment of FIG. 1.

When the temperature of the suction line 15 and thus in the evaporator 13 is excessive so that the conditions for forming ice on the freezing surface 12 are not favorable the pressure in the line 40 in the chamber 41 will press the diaphragm 42 down as viewed in FIG. 3 to move valve member 44 toward the closed position so that no water or a reduced volume of water as illustrated by the dotted arrows 45 and 46 can flow into the water line 26 and thus into the water passage 21. This water flow in the valve 25 is through a tubular portion 47 in the valve 25, past the valve 44 when it is open (it is closed in FIG. 3) and out a second tubular portion 48 at right angles to the first portion 47.

However, under the conditions illustrated in the drawings the valve member 44 is held closed by the pressure of the fluid in the bulb 39 and line 40 so that no water can flow. Once the temperature conditions of the low pressure side of the refrigerating means and thus at the freezing surface 12 are adequate for efficient freezing of the water to ice the pressure of the thermostatic fluid in the line 40 to ice the pressure of the thermostatic fluid in the line 40 decreases and a compression spring 49 in a spring chamber 50 which is normally held under compression raises the valve member 44 and opens the water supply passages in the valve 25 to provide water to the freezing space 21. For example, valve 44 starts to open at temperatures below 28° to 30° F.

By regulating the water supply in inverse ratio to the temperature of the freezing surface 12 the ice maker automatically compensates for changing conditions which can either be the ambient conditions of changing temperatures or operating conditions in the system itself. Thus the water supply is regulated proportionate to the capacity of the refrigerating means to make ice under varying operating conditions.

Figure 4:
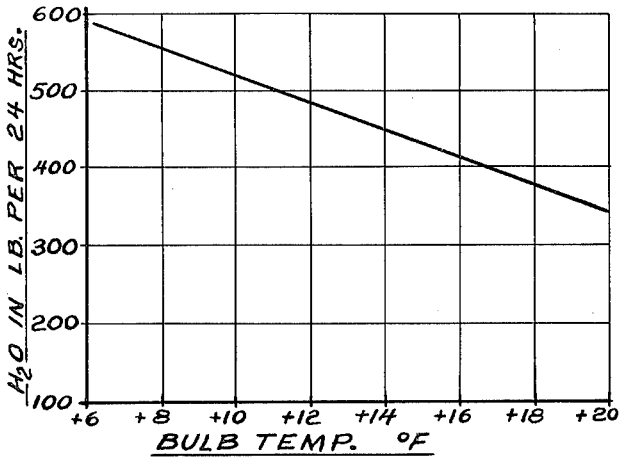
FIG. 4 is a graph illustrating an example of the operating conditions of an ice maker embodying the invention.

One example of varying the operating conditions is illustrated in FIG. 4. Here the abscissa of the graph illustrates varying bulb temperatures of the bulb 39 while the ordinate of the graph is marked in pounds of water supplied to the ice maker per 24 hours. As can be seen, when the bulb temperature is at the lower end of the scale or toward the left end of the abscissa the water supply is at the greatest while as the bulb temperature rises the water supply is correspondingly decreased.

Having described the invention, the embodiments of the invention in which an exclusive property or privilege is claimed are defined as follows:

1. In an ice maker comprising a feeezing surface member; a refrigerating means for refrigerating said freezing surface member to a subfreezing temperature having a low pressure side including an evaporator in heat exchange contact with said freezing surface member and a gaseous refrigerant suction line connecting said evaporator to a compressor, a high pressure side including said compressor, a condenser, a refrigerant line connecting said compressor and condenser, and a liquid refrigerant line connecting said evaporator to said condenser, and a thermostatic expansion valve connected in said liquid line and separating said high and low pressure sides of said refrigerating means; and harvesting means for removing said ice from said freezing surface member; the improvement comprising a variable flow water supply means for supplying water to said freezing surface member, said variable flow means comprising a thermostatic water valve means having a control portion responsive to temperature conditions of one of said high and low pressure sides of said refrigerating means for regulating the volumetric water supply to said freezing surface member proportionate to the capacity of said refrigerating means to form ice on said freezing surface member.

2. The ice maker of claim 1 wherein said thermostatic water valve means control portion includes a temperature sensing means responsive to low pressure side temperature conditions of said refrigerating means.

3. The ice maker of claim 1 wherein said thermostatic water valve means control portion includes a water valve temperature sensing bulb responsive to the temperature of said gaseous refrigerant suction line.

4. The ice maker of claim 3 wherein said thermostatic expansion valve includes an expansion valve temperature sensing bulb attached to said gaseous refrigerant suction line, said water valve temperature sending bulb being attached to said gaseous refrigerant suction line adjacent said expansion valve temperature sensing bulb.

5. The ice maker of claim 1 wherein said thermostatic water valve means reduces the volumetric water flow to zero at temperature conditions above a preselected temperature condition.

6. The ice maker of claim 1 wherein said thermostatic water valve means includes a valve body connected in the water supply line to said ice maker, a valve member in said valve body for controlling water flow through said valve body, a valve operating means in said valve body and said control portion includes a temperature sensing bulb operatively associated with said valve operating means and positioned to respond to low pressure side temperature conditions.

7. The ice maker of claim 6 wherein said temperature sensing bulb is attached to said gaseous refrigerant suction line in heat exchange relationship therewith.

8. The ice maker of claim 1 wherein said variable flow water supply means includes a pressure regulator connected between the water inlet to said ice maker and said thermostatic water valve means for supplying water to said valve means at substantially constant pressure.

9. The ice maker of claim 1 wherein said freezing surface member comprises an upstanding cylindrical surface, said variable flow water supply means supplies water to said surface adjacent the bottom of said cylindrical surface and includes a water outlet above said cylindrical surface, and wherein said variable flow water supply means supplies water in excess of that required for forming ice and said excess water flows through said outlet.

10. The ice maker of claim 9 wherein said outlet is connected to a drain whereby impurities in the water are carried to drain.

11. The ice maker of claim 1 wherein said freezing surface member comprises an upstanding cylindrical surface and said harvesting means comprises a harvest auger having blades extending to closely adjacent said cylindrical surface for harvesting ice pieces from said cylindrical surface.

12. The ice maker of claim 11 wherein said harvesting means includes a nozzle above said cylindrical surface and a compression auger carried by and rotatable with said harvest auger for driving ice pieces harvested by said harvest auger through said nozzle to compress the ice pieces into solid ice blocks.

13. The ice maker of claim 12 wherein said variable flow water supply means includes an outlet in the base of said nozzle for carrying excess water supplied to said cylindrical surface to drain with water removed from said ice as it is compressed in said nozzle.

14. In an ice maker for continuous production of ice including an upright cylindrical ice freezing surface; a refrigerating means for said surface including an evaporator in heat exchange contact with said surface, a compressor, a condenser, a liquid refrigerant line connecting said evaporator to said condenser, a gaseous refrigerant suction line connecting said evaporator to said compressor, and a thermostatic expansion valve connected in said liquid line and responsive to the temperature of said suction line; and a rotatable harvest auger for removing ice from said ice freezing surface; the improvement comprising a variable flow water supply means for supplying water to said cylindrical freezing surface in excess of the amount required for the ice formed including a thermostatic water valve having a control portion responsive to the temperature of said suction line for regulating the volumetric water supply to said cylindrical freezing surface in inverse ratio to the temperature of said suction line.

15. The ice maker of claim 14 wherein said thermostatic expansion valve includes an expansion valve temperature sensing bulb attached to said gaseous refrigerant suction line, and said thermostatic water valve control portion includes a water valve temperature sensing bulb attached to said gaseous refrigerant suction line adjacent said expansion valve temperature sensing bulb.

16. The ice maker of claim 15 wherein said variable flow water supply means includes a pressure regulator connected between the water inlet to said ice maker and said thermostatic water valve means for supplying water to said valve means at substantially constant pressure.

* * * * *